United States Patent [19]

Gray

[11] Patent Number: 4,725,211

[45] Date of Patent: Feb. 16, 1988

[54] GEAR PUMPS

[75] Inventor: William G. Gray, Bury, England

[73] Assignee: Maag Gear-Wheel Company Ltd., Zurich, Switzerland

[21] Appl. No.: 811,173

[22] Filed: Dec. 18, 1985

[30] Foreign Application Priority Data

Jan. 5, 1985 [GB] United Kingdom ..... 8500273

[51] Int. Cl.[4] ..... F04C 2/18; F04C 13/00; F04C 15/00

[52] U.S. Cl. ..... 418/102; 418/206

[58] Field of Search ..... 418/102, 205, 206; 425/376 B

[56] References Cited

U.S. PATENT DOCUMENTS

| | | | |
|---|---|---|---|
| 1,927,749 | 9/1933 | Kimmig | 418/102 |
| 2,531,726 | 11/1950 | Durdin | 418/206 |
| 3,203,355 | 8/1965 | Purcell | 418/206 |
| 3,799,713 | 3/1974 | Cloots et al. | 418/206 |
| 3,817,668 | 6/1974 | Mayer et al. | 418/206 |
| 4,384,828 | 5/1983 | Rembold et al. | 418/102 |
| 4,515,512 | 5/1985 | Hertell et al. | 418/102 |

FOREIGN PATENT DOCUMENTS

| | | | |
|---|---|---|---|
| 525358 | 1/1954 | Belgium | 418/102 |
| 677462 | 12/1929 | France | 418/102 |
| 1150488 | 8/1957 | France | 418/206 |
| 2686 | of 1867 | United Kingdom | 418/206 |
| 265511 | 2/1927 | United Kingdom . | |
| 492001 | 9/1938 | United Kingdom . | |
| 705751 | 3/1954 | United Kingdom . | |

*Primary Examiner*—John J. Vrablik

*Attorney, Agent, or Firm*—Trexler, Bushnell, Giangiorgi & Blackstone, Ltd.

[57] ABSTRACT

To avoid areas of slow moving or stagnant polymer in a gear pump feeding from an extruder to a die, the inlet port (7) has its cross-section changing progressively from that of the outlet (10) of the extruder to a slot section (11) at the demeshing region of the gear teeth, the slot section having a breadth at least equal to the breadth of the gears (3, 4) and a height between one and four times the gear teeth height, and the outlet port (8) preferably changes progressively from a similar slot section (16) at the meshing region of the gear teeth to the cross-section of the inlet (17) of the die.

5 Claims, 7 Drawing Figures

GEAR PUMPS

This invention relates to gear pumps and in particular to gear pumps suitable for use with thermally degradable polymers.

In a conventional extrusion process for manufacturing continuous lengths of plastics products, a screw extruder is used to force molten polymer through a die. The output of a screw extruder can vary, due for example to variability in the plastics material, or to variations in screw speed or to temperature fluctuation of the extruder or die or to variation in the impedance of the die assembly, due for example to screens or filters becoming blocked by impurities. This can lead to difficulties in controlling the weight or dimensions of extruded products.

It has long been common practice for example in melt spinning of man-made fibres, to overcome this problem by interposing a gear pump or pumps between the extruder and the die, the output of a gear pump being relatively insensitive to variations in material or temperature or back pressure from the die assembly.

More recently, there has been a growing use of gear pumps interposed between the extruder and the die for accurate control during the extrusion of plastics film and pipe. The preferred form of gear pump for such applications is of the type in which the inlet and outlet ports of the pump are coaxial and coextensive with the outlet of the extruder and the inlet of the die respectively and are perpendicular to the axes of the gear wheels of the pump.

Such pumps have been successfully used for the extrusion of polymeric materials which are relatively stable at the temperatures at which they are extruded, such as polyethylene and other polyolefinic polymers. However, it has been found that available gear pumps of this type are unsuitable for use with polymeric materials which suffer degradation at extrusion temperatures, such as unplasticised or rigid polyvinyl chloride which is widely used for the manufacture of pipes and profiles, as their construction results in areas of slow moving or stagnant polymer where thermal degradation of the polymeric material can take place leading to discolouration of and/or physical weaknesses in the extruded products.

A further disadvantage of known pumps of the preferred type is that the polymeric material is used to lubricate the gear shaft bearings by being bled from the outlet port of the pump, through the bearings and returned to the inlet port. This is satisfactory with polymeric materials which are relatively non thermally degradable but with polymeric materials such as unplasticised polyvinyl chloride, such treatment results in a high level of degradation which also leads to discolouration of or physical defects in the products.

Two independent objects of the present invention are to provide a gear pump of the type referred to for use with thermally degradable polymers and which overcomes the disadvantages of the known gear pumps of this type when used with such materials.

According to one aspect of the present invention, a gear pump of the type in which the material being pumped is used to lubricate the gear shaft bearings has a bleed from one of the ports, preferably from the inlet port, to the bearings, and passages from the bearings to waste, and from the bearings the flow rate is preferably mechanically assisted and controlled by means of helical flights on an extension of at least one of the gear shafts or by means of a helical groove cut into a bearing block of an extension of at least one of the gear shafts.

According to another aspect of the present invention, a gear pump of the type in which the inlet and outlet ports are coaxial and coextensive with the outlet of the extruder and the inlet of the die respectively and are perpendicular to the axes of the gear wheels, has at least the cross-section of the inlet port changing progressively from that of the outlet of the extruder to a slot section at the demeshing region of the gear teeth, and preferably also has the cross-section of the exit port changing progressively from a slot section at the meshing region of the gear teeth to the cross-section of the inlet of the die, the slot section having a breadth at least equal to the breadth of the gears and a height between one and four times the gear teeth height.

The shaping of the inlet and outlet ports according to the invention, allows material to flow in a smooth fashion through the pump and eliminates areas of slow moving or stagnant material which can degrade and cause defects in the products.

Fuller understanding of both aspects of the invention will be gained from the following description, by way of example only, with reference to the accompanying diagrammatic drawings, in which:

FIG. 1 is a longitudinal section through a gear pump of the known type and illustrating the need for the first aspect of the invention;

FIG. 2 corresponds to FIG. 1 but shows a gear pump in accordance with the first aspect of the invention;

Figure 1:
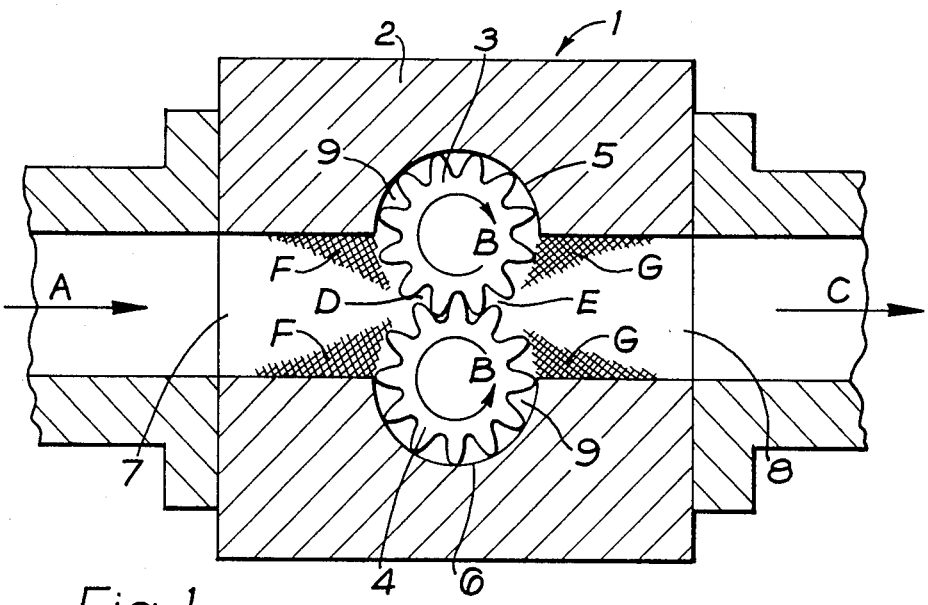
Fig. 1 PRIOR ART

In FIG. 1 a gear pump 1 of known type comprises a pump body 2, which may have provision for heating, a pair of intermeshing gears 3 and 4 which rotate in the direction shown by arrows B within gear housings 5 and 6, an inlet port 7 and an outlet port 8. The inlet and outlet ports are normally of circular section, but may be other shapes to suit particular extruders or dies. Material from the outlet of the extruder (not shown) enters the inlet port 7 in the direction shown by arrow A. At point D where the teeth of gears 3 and 4 de-mesh, material is entrained into the cavities 9 between adjacent teeth of gears 3 and 4 and is transported round housings 5 and 6 until it reaches point E where the gear teeth mesh, when it is forced out of the cavities into the outlet port 8 and thence to the inlet of the extrusion die (not shown) in the direction shown by arrow C. When the material being pumped in is of high viscosity, for example a polymer melt, there is little or no exchange of material between the filled cavity and the material in the inlet port after the cavity has filled at point D. Thus, material in the cross-hatched areas F tends to be slow moving or stagnant and if the material is prone to thermal degradation it may lead to discolouration and/or physical weaknesses in the extruded product. Similarly, since material is expelled from the cavities only at the point E where the gear teeth mesh, material in the cross-hatched areas G of the outlet port also tends to be slow moving or stagnant. Moreover, since the profile of the gear teeth is such that the outer edges of the teeth remain in contact with the face of the opposing teeth over much of the meshing or demeshing operation, a major portion of the material tends to enter or be expelled from the ends of the cavities, which results in the material at the centre of the inlet or outlet ports moving more slowly than material at the edges of the gear teeth.

Figure 2:
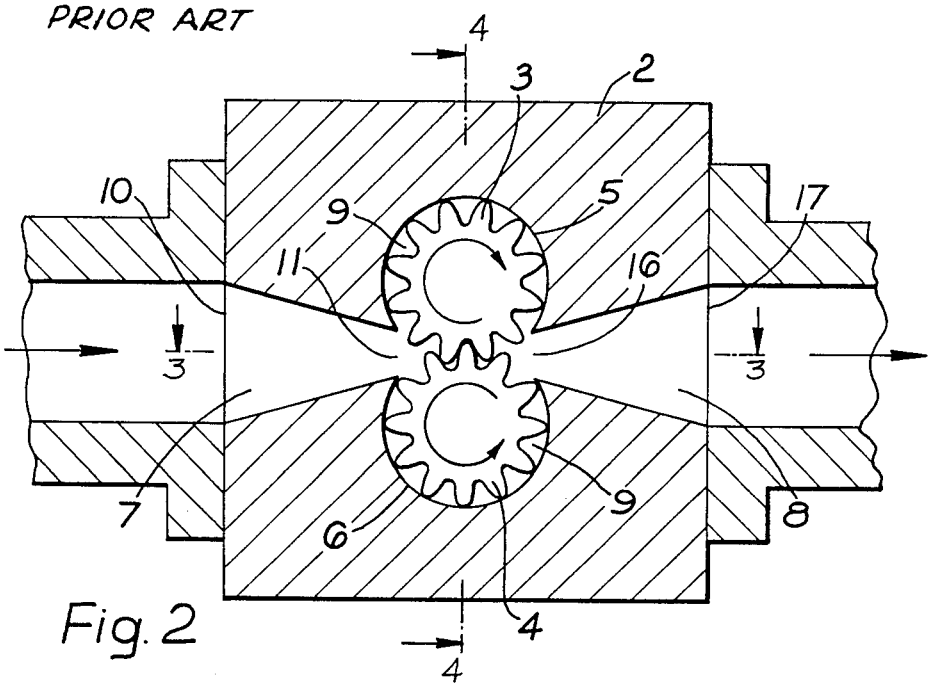
Figure 3:
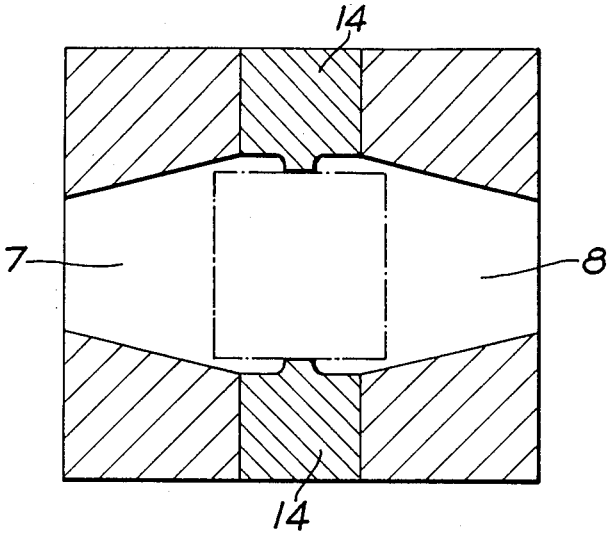
FIG. 3 is a section on the line 3—3 of FIG. 2 with the gears indicated in broken line.
Figure 4:
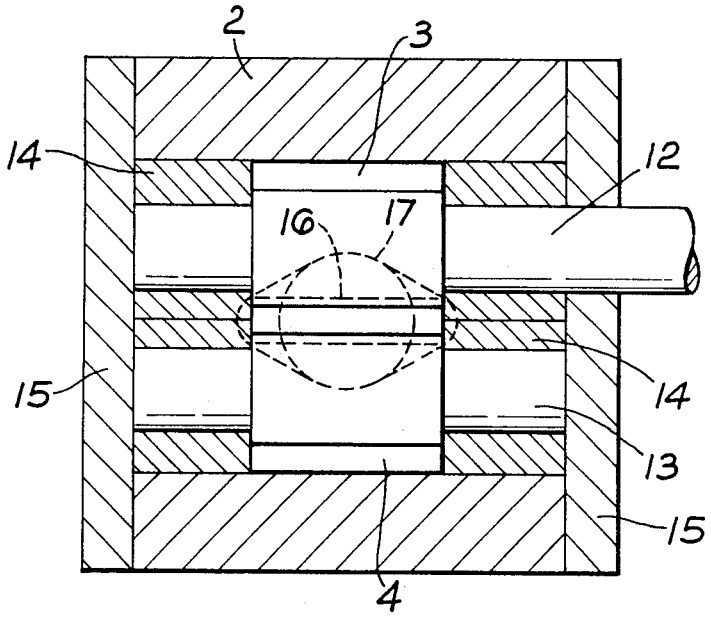
FIG. 4 is a section on the line 4—4 of FIG. 2.

In FIGS. 2 to 4, a gear pump according to one aspect of the invention has the inlet port 7 shaped so that its cross-section changes in a smooth and progressive manner from a circular section 10 at the outlet of the extruder to a slot section 11 at the demeshing region of the gear teeth. The outlet port 8 is shaped so that its cross-section changes in a smooth and progressive manner from a slot section 16 to a circular section 17 at the inlet to the die. The height of the slot section 11 or 16 is twice the gear tooth height. FIG. 3 shows how the inlet port 7 widens to a breadth exceeding the breadth of the gears to assist with material feed to the gear cavities, the gear shaft bushes 14 being profiled to feed the material into the gear cavities from their ends. FIG. 3 also shows how the outlet port 8 diminishes in width correspondingly. FIG. 4 shows the pair of intermeshing gears 3 and 4 integral with gear shafts 12 and 13, of which the shaft 12 is a drive shaft, and shaft bearings 14, the whole assembly being enclosed in the pump body 2 by end plates 15.

Although the transition from circular section to slot section is shown in FIGS. 2, 3 and 4 as being straight, the transition may be made in other ways provided it is smooth and progressive. For example, it may be advantageous for the initial part of the entry port to remain circular for a short distance before commencing the transition to the slot section.

Figure 5:
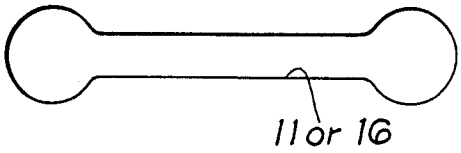
FIG. 5 shows a modified shape of slot section.

Similarly, the slot section need not necessarily be as shown in FIG. 4. For example the slot may advantageously be as shown in FIG. 5 with a widening at the ends to allow for the greater material flow at the edges of the gears, thus maintaining a relatively constant flow rate across the width of the slot.

Figure 6:
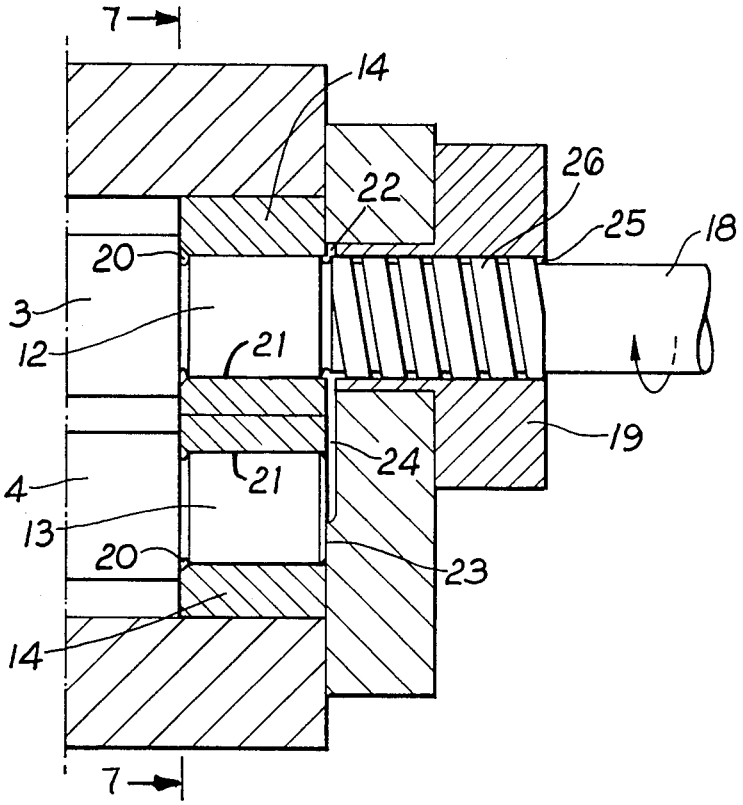
FIG. 6 is a half section of a gear pump according to the second aspect of the invention.
Figure 7:
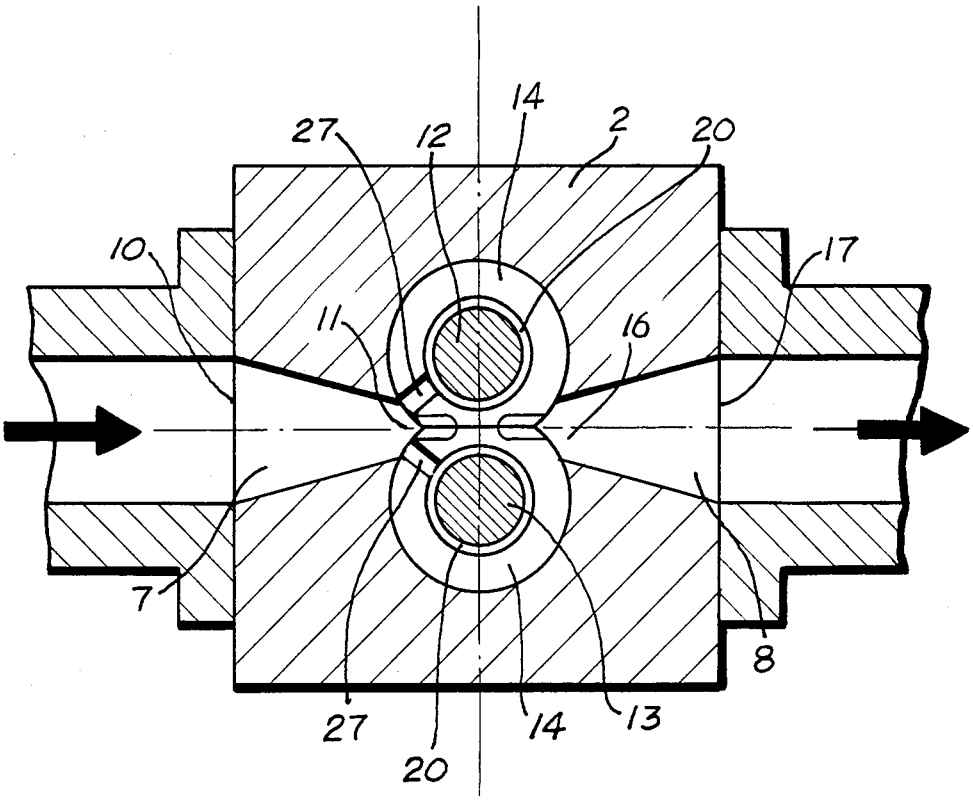
FIG. 7 is a sectional view, similar to FIG. 2 with gears removed, taken along line 7—7 in FIG. 6, viewed in the indicated direction and illustrating grooves formed in the bearing bushes for diverting a lubrication bleed from the main flow.

As shown in FIG. 6 and 7 the gear pump has a pair of intermeshing gears 3 and 4 mounted on or integral with gear shafts 12 and 13 borne in bushes 14. The upper gear 3 is driven by means not shown connected to an extension 18 of its drive shaft, which has a bearing block 19. Lubrication of the gear shafts 12 and 13 in their bushes is effected by means of material bled from the outlet port or, preferably, from the inlet port through grooves 27 in the bearing bushes 14, the material initially feeding into annular spaces 20 before lubricating the bearing surfaces 21. In accordance with the other aspect of the invention, the material that has lubricated the bearings passes to further annular spaces 22 and 23, and material from the annular space 23 is fed through a passage 24 to the annular space 22. The combined material in the annular space 22 then passes through an annular space between the extended drive shaft 18 and its bearing block 19 and exudes from orifice 25, from where it may be fed by suitable means (not shown) to a convenient point for collection and disposal. Preferably, as shown, the flow through the annular space is mechanically assisted and controlled by helical flights 26 on the portion of the shaft which is encased in bearing block 19, the flights acting in the same manner as an extruder screw. The pitch and depth of screw flights 26 are chosen such that the residence time of the lubricating material does not lead to a degree of degradation which could affect the mechanical performance of the pump. Alternatively, mechanical assistance and control of the polymer flow may be by means of a helical groove cut into the bearing block 19.

The disposal of lubrication material from the opposite half of the pump (not shown) may be achieved in a similar manner or alternatively the material from both bearings may be fed through suitable passages to annular space 22 to be exuded from orifice 25.

Although in the embodiment illustrated the material disposal means is on drive shaft 18, it may equally be achieved by similar extensions of any one or more of the other gear shafts.

What I claim is:

1. A gear pump for interposing between an extruder for thermally degradable polymer and die therefor, the gear pump comprising a pump body, gear housings in the pump body, a pair of intermeshing gears within the gear housings, an inlet port in the pump body for feeding polymer from the outlet of an extruder to where the gears de-mesh, an outlet port for feeding polymer from where the gears mesh to the inlet of a die, gear shafts carrying the gears, bearings in the pump body for the shaft, an extension of at least one of the gear shafts for connection to drive means, and a bearing block for the said extension; characterized in that an annular space is provided around each gear shaft adjacent the respective gear, bleed means is provided from one of the ports to all of the said annular spaces, helical channel means is provided between the gear shaft extension and its bearing block, and passage means is provided between the end of each gear shaft remote from the respective gear and the end of the helical groove means nearest the respective gear wherein said passage means includes annular spaces provided at the ends of the gear shafts remote from the gears, one of the said further annular spaces being in communication with the helical channel means provided between the gear shaft extension and its bearing block, and a passage is provided between the said further annular spaces; said bleed means, said annular spaces and said helical channel means being arranged to allow bearing lubrication flow therethrough directed only away from said gears, whereby polymer being pumped is bled from the respective port to the aforesaid annular spaces to lubricate the bearings during movement of the polymer from the annular spaces to the ends of the gear shafts remote from the gears, and the material that has lubricated the bearings passes to the helical groove means which mechanically assists and controls the flow of the material to waste.

2. A gear pump for interposing between an extruder for thermally degradable polymer and a die therefor, and also of the type in which the inlet and outlet ports are coaxial and axially perpendicular to the axis of the gears and are adapted to be coextensive with the outlet of an extruder and the inlet of a die respectively, the gear pump comprising a pump body, gear housings in the pump body, a pair of intermeshing gears within the gear housings, an inlet port in the pump body for feeding polymer from the outlet of an extruder to where the gears de-mesh, an outlet port for feeding polymer from where the gears mesh to the inlet of a die, gear shafts carrying the gears, bearings in the pump body for the shafts, an extension of at least one of the gear shafts for connection to drive means, and a bearing block for the said extension; characterized in that an annular space is provided around each gear shaft adjacent the respective gear, bleed means is provided from one of the ports to all of the said annular spaces, helical channel means is provided between the gear shaft extension and its bearing block, and passage means is provided between the end of each gear shaft remote from the respective gear and the end of the helical groove means nearest the respective gear; said bleed means, said annular spaces and said helical channel means being arranged to allow bearing lubrication flow therethrough directed only away from said gears, whereby polymer being pumped is bled from the respective port to the aforesaid annular spaces to lubricate the bearings during movement of the polymer from the annular spaces to the ends of the gear shafts remote from the gears, and the material that has lubricated the bearings passes to the helical groove means which mechanically assists and controls the flow of the material to waste; wherein the cross-section of the outlet port changes progressively from a slot section at the meshing region of the gear teeth to the cross-section of the inlet of the die, the slot section having a breadth exceeding the breadth of the gears and a maximum height of twice the gear tooth height.

3. A gear pump as in claim 2, wherein the slot section is widened at its ends.

4. A gear pump as in claim 2, wherein the cross-section of the inlet port changes progressively from that of the outlet of the extruder to a slot section at the demeshing region of the gear teeth, the slot section having a breadth exceeding the breadth of the gears and a maximum height of twice the gear tooth height.

5. A gear pump as in claim 4, wherein the slot section is widened at its ends.

* * * * *